US006351874B1

(12) United States Patent
Suggs

(10) Patent No.: US 6,351,874 B1
(45) Date of Patent: Mar. 5, 2002

(54) CLASP FOR SECURING A STRAP END

(75) Inventor: Gregory M. Suggs, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 3 days.

(21) Appl. No.: 09/629,060

(22) Filed: Jul. 31, 2000

(51) Int. Cl.[7] ..... A44B 11/06; A44B 21/00
(52) U.S. Cl. ..... 24/265 BC; 24/265 R
(58) Field of Search ..... 24/265 R, 265 EC, 24/265 BC, 316, 265 AL, 168, 169, 265 H

(56) References Cited

U.S. PATENT DOCUMENTS 194,984 A * 9/1877 Bradley ..... 24/265 BC
5,669,119 A * 9/1997 Seron ..... 24/265 R

* cited by examiner

*Primary Examiner*—Robert J. Sandy
(74) *Attorney, Agent, or Firm*—Darrell F. Marquette

(57) ABSTRACT

The clasp for use with an adjustable length strap of the type used on a golf bags, back packs and the similar articles includes a housing having a open passage and a blind compartment in stacked relationship with respect to each other and a hinged lid overlays the blind compartment. The strap has a first end fixedly attached to the article and is positioned to slidably extend through the open passage of the clasp. The free end of the strap is looped through a ladder-lock buckle or similar device carried on the article, and the looped-over portion of the strap is placed in juxtaposed overlaying relationship with the main portion of the strap, and the free end of the strap is placed in the compartment of the clasp and held therein by closing of the hinged lid. Adjustment of the strap to a desired length is accomplished by sliding movement of the strap through the ladder-lock buckle so as to either increase or decrease the length of the main portion of the strap and this is accomplished without disturbing the clasp in that the strap is slidably movable through the passage formed in the clasp.

11 Claims, 1 Drawing Sheet

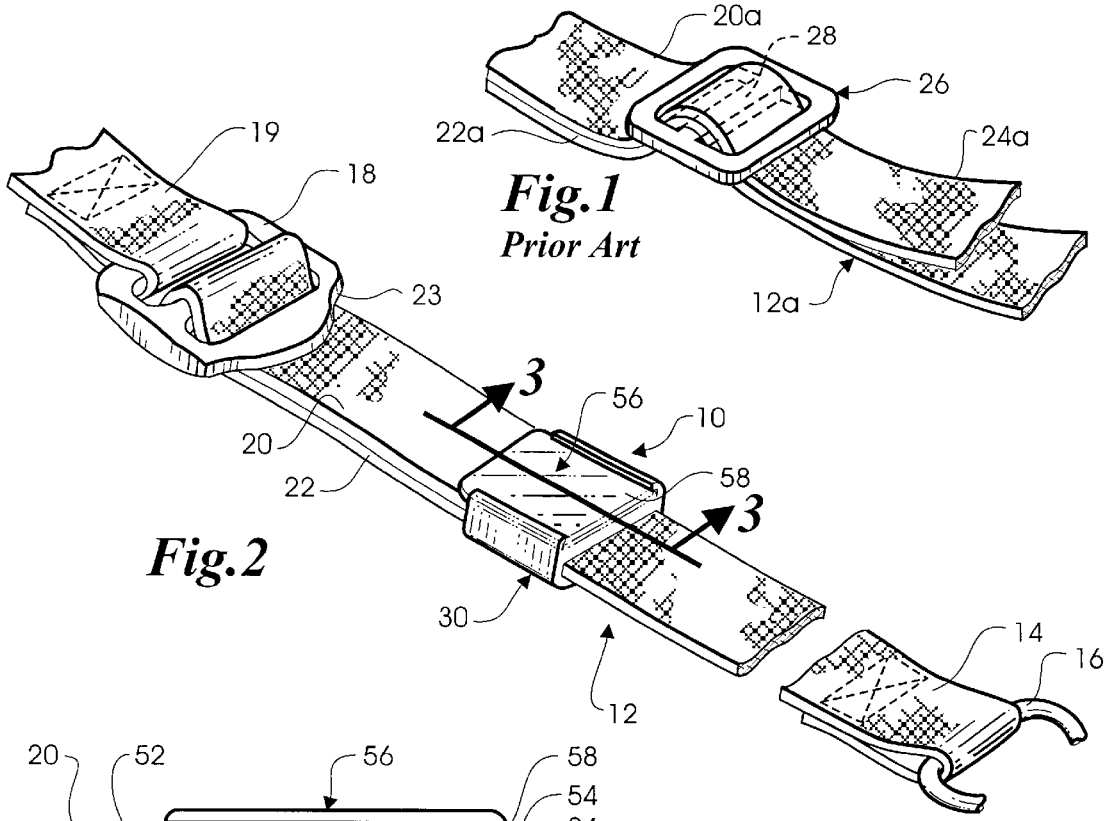
Fig.1
Prior Art
Fig.2
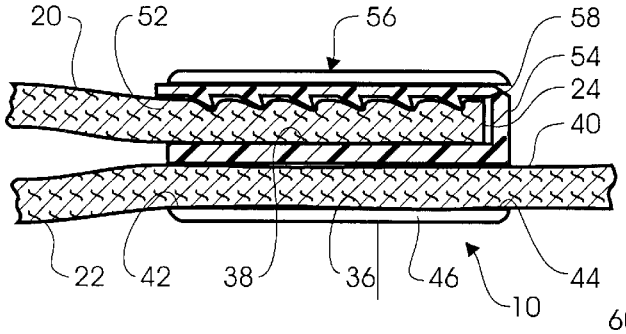
Fig.3
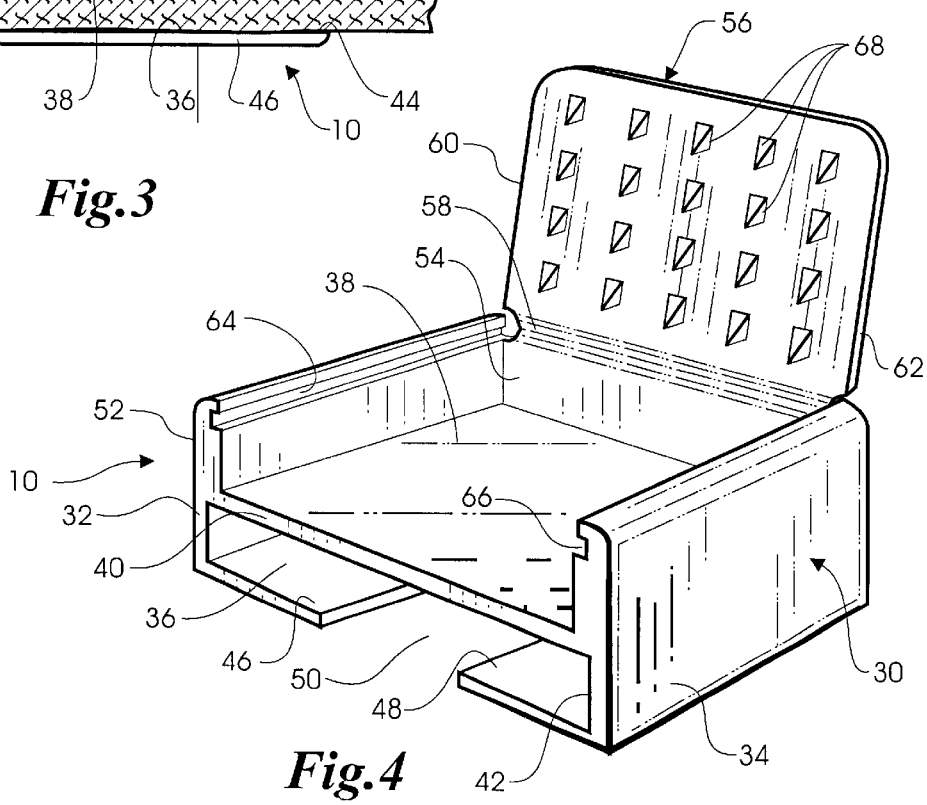
Fig.4

CLASP FOR SECURING A STRAP END

BACKGROUND OF THE INVENTION

This invention relates in general to hardware for use with straps or belts and, more particularly, to a clasp for securing a free end of an adjustable length strap.

Straps of the type used on golf bags, back packs and similar articles, are usually adjustable so that their length can be changed to the desired size or personal preference of the person carrying or otherwise using the article. Adjustable straps usually have one end fixedly attached to the article such as by use of a D-ring with the other end of the strap being looped through a ladder-lock buckle and laid back upon the main portion of the strap. Adjustment of the overall length of the strap is accomplished by pulling the looped over portion of the strap through the ladder-lock buckle until the desired length of the main portion of the strap is achieved. The ladder-lock buckle can be held in an open position to allow the strap to be freely moved through the buckle and upon being released, the buckle can be moved into a closed position which locks the strap in the desired position. When locked in the desired position, the main and the looped-over portions of the strap are in juxtaposed overlaying relationship with respect to each other and the free end of the looped over portion of the strap is customarily held in place by being attached to the main portion of the strap. Attachment of the looped-over and main portions of the strap to each other is normally accomplished by a buckle, which will hereinafter be referred to as a tie-down buckle. Both the main and looped-over portions of the strap are threadingly passed through the tie-down buckle which frictionally grips both portions of the strap and securely holds them in place. While this commonly used method of securing the looped-over portion of the strap in the juxtaposed position relative to the main portion of the strap accomplishes the purpose for which it is intended, the free end of the looped-over portion of the strap protrudes from the tie-down buckle and this give the strap installation an unfinished appearance and the free end can become tangled with other parts of the article to which the strap is attached or can otherwise interfere with the use of the article. In addition, this prior art method of securely attaching the looped over and main portions of the strap to each other makes it difficult to change the overall length of the strap whenever such a change is desired or needed. With both the main and looped over portions of the strap being held fast by the tie-down buckle, they must be loosened whenever changes in the length of the strap are to be made and sometimes such loosening is not easy due to the bulk of the straps.

SUMMARY OF THE INVENTION

In accordance with the present invention, a new and useful clasp is disclosed for securely enclosing the free end of the looped-over portion of an adjustable strap while leaving the looped-over and main portions of the strap free for length adjustment purposes.

The clasp includes a housing having a open passage and a blind compartment in stacked relationship with respect to each other and a hinged lid overlays the blind compartment. Installation of the clasp of the present invention on the adjustable length strap that is to be used on an article such as a golf bag, back pack or the like, is accomplished by suitably affixing one end of the strap to the article in the customary manner and installing the main portion of the strap so that it is disposed and freely slidable in the open passage of the clasp. The other end of the strap is then looped through a ladder-lock buckle which is being held in the open position so that the strap can be pulled through the buckle. When the desired length of the main portion of the strap has been determined, the ladder-lock buckle is moved to the closed position to hold the strap fast against unwanted movements. When adjusted and locked in this manner, the looped-over portion of the strap will be in juxtaposed overlaying relationship with the main portion of the strap and the free end of the looped over portion of the strap is placed in the blind compartment of the clasp and is securely contained therein when the hinged lid is moved into gripping engagement therewith.

In the event that subsequent readjustment of the length of the adjustable strap is needed or desired, movement of the ladder-lock buckle to its open position will allow the strap to be moved freely through the buckle for adjusting the overall length of the strap and such adjustment can be accomplished without disturbing the clasp of the present invention. When the strap is being moved through the ladder-lock buckle, the main portion of the strap will freely move through the open passage of the clasp and thus not interfere with movements of the strap through the ladder-lock buckle. When the new length of the main portion of the strap has been determined and held in that position by closing of the ladder-lock buckle, the clasp can be slidably moved along the main portion of the strap into the new location of the free end of the looped-over portion of the strap.

Accordingly, it is an object of the present invention to provide a new and useful clasp for securely enclosing the free end of the looped-over portion of an adjustable length strap while leaving the looped-over and main portions of the strap free for length adjustment purposes.

BRIEF DESCRIPTION OF THE DRAWINGS

FIG. 1 is a fragmentary perspective view of an adjustable length strap showing a typical prior art buckle which holds the looped-over portion of the strap in juxtaposed overlaying relationship with the main portion of the strap.

FIG. 2 is a fragmentary perspective view of an adjustable length strap with the clasp of the present invention mounted thereon.

FIG. 3 is an enlarged sectional view taken along the line 3—3 of FIG. 2.

FIG. 4 is a perspective view of the clasp of the present invention showing the various features thereof

DESCRIPTION OF THE PREFERRED EMBODIMENT

Referring more particularly to the drawings, FIGS. 2, 3 and 4 show the clasp of the present invention which is indicated generally by the reference numeral 10. The clasp 10 is shown as being installed on a typical adjustable length strap 12 of the type commonly used on golf bags, back packs and similar articles.

To insure a complete understanding of the purpose and use of the clasp 10, the following description of the adjustable strap 12 and the hardware associated therewith, is presented with it being understood that many variations in the configuration of the hardware, mounting arrangement and the like, are in common use and the illustrated configurations and the descriptions thereof which follows are typical and are not to be construed as limitations to the present invention.

Such adjustable length straps 12 are normally provided with a fixed end 14 which is attached such as by sewing to a D-ring 16 which is intended to be representative of the types of connection devices that are used to interconnect the article (not shown) and the strap 12. The other end of the strap 12 is looped through a buckle 18 of the type commonly referred to as a "ladder-lock buckle" which is carried on one end of a fixed length strap 19 that has its other end (not shown) attached such as by sewing to the article. With the strap 12 being looped through the ladder-lock buckle 18, it is folded back upon itself to provide the strap 12 with a looped-over portion 20 in a juxtaposed overlaying relationship with a main portion 22 of the strap 12. Adjustments in the length of the strap 12 are made by lifting up the tab 23 of the ladder-lock buckle 18 to move it into a substantially perpendicular attitude relative to the length of the strap 12 and that position may be described as an open position. When the buckle 18 is in the open position, the strap 12 may be freely moved through the buckle 18 to change the length of the main portion 22 of the strap 12 and thereby alter the overall length of the strap 12. When the strap 12 has been adjusted to the desired length, the ladder lock buckle 18 is returned to the position shown in FIG. 2 which may be referred to as its closed position, and when closed, the buckle 18 will firmly hold the strap 12 in the desired position.

Reference is now made to FIG. 1 wherein a prior art buckle 26 is shown with that buckle 26 being referred to herein as a"tie-down buckle" as previously mentioned. The tie-down buckle 26 has a central bar 28 which separates the two openings formed through the buckle 26 and both the main portion 22*a* and the looped-over portion 20*a* of the strap 12*a* are threaded up through a first one of the openings, over the central bar 28 and down through the second opening. When the buckle 26 is mounted on the strap 12*a* in this manner, the strap 12*a* will be frictionally gripped by the buckle 26 to hold the looped-over portion 20*a* in the juxtaposed overlaying position on the main portion 22*a*. However, the free end 24*a* of the strap 12*a* will protrude from the tie-down buckle 26, and the strap 12*a* will have to be loosened in the buckle 26 whenever adjustments to the overall length of the strap 12*a* are to be made.

The clasp 10 of the present invention is formed of a suitable synthetic resin as will hereinafter be described in detail and includes a housing 30 having a spaced apart pair of side walls 32 and 34 with the side walls 32, 34 forming opposite sides of a lower passage 36 and an upper compartment 38. The lower passage 36 and the upper compartment 38 are separated from each other by a partition 40 which extends perpendicularly between the spaced apart side walls 32 and 34 and interconnects them at their approximate centers.

The lower passage 36 is open at both of its ends 42 and 44, and ledges 46 and 48 extend from lower edges of the side walls 32 and 34 toward each other to form a bottom of the lower passage 36 while providing an opening 50 which extends between the open ends 42 and 44 of the passage 36. The clasp 10 is positionable on the main portion 22 of the strap 12 so that the strap 12 will protrude in opposite directions from the lower passage 36 through the open ends 42 and 44 thereof as seen best in FIG.3. The clasp 10 is configured so that the strap 12 is slidably movable through the lower passage 36, and the clasp 10 may be mounted on the strap 12 by either passing the strap free end 24 through the open ends 44 and 42 of the passage 36 or by inserting any portion of the strap 12 along its length into the passage 36 through opening 50 thereof The upper compartment 38 has one open end 52 and the compartment 38 may be described as being"blind" in that its opposite end is closed by an upstanding wall 54. The top of the compartment 38 is open and may be selectively closed by a lid 56 that extends integrally from and is interconnected with the upper edge of the wall 54 with this interconnection being accomplished by a living hinge 58. The lid 56 is movable between an open position as shown in FIG. 4 and a closed position as seen in FIG. 3. When moved toward the closed position, opposite side edges 60 and 62 of the lid 56 will move into engagement with upper ends of the side walls 32 and 34 and deflect them outwardly so that the side edges 60 and 62 of the lid 56 will enter with a snapping action into inwardly facing grooves 64 and 66 formed to extend along the length of the side walls 32 and 34 adjacent the upper ends thereof. An array of teeth 68 are formed to protrude from the inwardly facing surface of the lid 56 to grip the free end 24 of the strap 12 when it is placed in the blind compartment 38 as shown in FIG. 3.

It will be apparent from the above description that the overall length of the strap 12 may be altered in the above described manner without disturbing the clasp 10. Since the strap 12 is slidably movable through the lower passage 36 of the housing 30, the strap 12 is free to be moved through the ladder-lock buckle 18 whenever adjustments of the overall length of the strap 12 are being made and the clasp 10 is freely movable into the relocated position of the free end 24 of the looped-over portion of the strap 12.

Also, from the above description it will be apparent that the housing 30 must be formed of a material having special characteristics which allows the resilient deflective movement of the side walls 32 and 34 when the lid 56 is snapped shut, and a similar deflective movement to reopen the lid 56 if removal of the clasp 10 from the strap 12 is desired. That same material must allow the living hinge 58 to be formed therein by techniques well known in the art. Such forming is accomplished by moving, i.e. working the lid 56 back and forth when it first comes out of the mold. A material suitable for use in forming the clasp 10 is Polypropylene.

What is claimed is:

1. A clasp for use with an adjustable length strap of the type having a fixed end, a main portion, a looped-over portion and a free end, said clasp comprising:

a housing for attachment to the strap, said housing defining a passage having opposed open ends with the main portion of the strap being disposed in the passage and extending in opposite directions through the opposed open ends thereof;

said housing further defining a compartment in a juxtaposed relationship with the passage formed therein with the compartment having at least one open end and an open top for receiving the free end of the strap when the main portion of the strap extends through the passage formed in said housing and the looped-over portion of the strap in a juxtaposed position relative to the main portion of the strap;

said housing further having a lid proximate the compartment for movement into a closed position within the open top of the compartment for engaging the free end of the strap when the free end is placed therein;

said housing further including a spaced apart pair of side walls which define opposite sides of the passage and the compartment, and a partition extending between the spaced apart pair of side walls to interconnect the pair of side walls and separate the passage and the compartment; and said housing further including a pair of ledges extending inwardly toward each other from lower ends of said spaced apart pair of side walls to form a bottom for the passage while providing an opening in the bottom of the passage which extends between the opposed open ends of the passage.

2. A clasp as claimed in claim 1, wherein the compartment formed in said housing is blind.

3. A clasp as claimed in claim 1, further comprising an upstanding wall closing an opposite end of the compartment.

4. A clasp as claimed in claim 3, wherein said housing further comprises a hinge interconnecting the lid and an upper end of the upstanding wall.

5. A clasp as claimed 3, in wherein said housing further comprises a living hinge interconnecting the lid and an upper end of the upstanding wall.

6. A clasp for use with an adjustable length strap of the type having a fixed end, a main portion, a looped-over portion and a free end, said clasp comprising:

a housing for attachment to the strap, said housing defining a passage having opposed open ends with the main portion of the strap being disposed in the passage and extending in opposite directions through the opposed open ends thereof;

said housing further defining a compartment in a juxtaposed relationship with the passage formed therein with the compartment having at least one open end and an open top for receiving the free end of the strap when the main portion of the strap extends through the passage formed in said housing and the looped-over portion of the strap in a juxtaposed position relative to the main portion of the strap;

said housing further having a lid proximate the compartment for movement into a closed position within the open top of the compartment for engaging the free end of the strap when the free end is placed therein;

said housing further including a spaced apart pair of side walls which define opposite sides of the passage and the compartment with an inwardly facing pair of grooves each formed adjacent a top edge of one of the pair of side walls;

a partition extending between the spaced apart pair of side walls to interconnect the pair of side walls and separate the passage and the compartment;

an upstanding wall closing an opposite end of the compartment;

a hinge interconnecting the lid with an upper end of the upstanding wall; and the lid having opposite side edges which enter into the inwardly facing pair of grooves formed in the pair of side walls when the lid is moved into the closed position.

7. A clasp as claimed in claim 1, wherein the lid is provided with an array of teeth which grip the free end of the strap when it is positioned in the compartment and the lid is moved into the closed position.

8. A clasp for use with an adjustable length strap of the type having a fixed end, a main portion, a looped-over portion and a free end, said clasp having a housing which comprises:

a passage formed in said housing and having opposed open ends with the main portion of the strap being disposed in the passage and extending in opposite directions through the opposed open ends thereof with the main portion of the strap being slidably movable in said passage for locating said housing at a desired location along the length of the main portion of the strap;

a blind compartment formed in said housing in stacked relationship with the passage and having one end closed by an upstanding wall and an opposite end and a top being open for receiving the free end of the strap when the main portion of the strap extends through the passage and the looped-over portion of the strap is in a juxtaposed position relative to the main portion of the strap;

a lid mounted on an upper end of the upstanding wall of said compartment for movement into a closed position with the top of the compartment for grippingly engaging the free end of the strap when the free end is placed therein;

said housing further including a spaced apart pair of side walls which define opposite sides of said passage and said compartment, and a partition extending between the spaced apart pair of side walls to interconnect the pair of side walls and separate said passage and said compartment; and said housing further including a pair of ledges extending inwardly toward each other from lower ends of said spaced apart pair of side walls to form a bottom for said passage while providing an opening in the bottom of said passage which extends between the opposed open ends of said passage.

9. A clasp as claimed in claim 8, further comprises a living hinge interconnecting said lid and an upper end of the upstanding wall.

10. A clasp for use with an adjustable length strap of the type having a fixed end, a main portion, a looped-over portion and a free end, said clasp having a housing which comprises:

a passage formed in said housing and having opposed open ends with the main portion of the strap being disposed in the passage and extending in opposite directions through the opposed open ends thereof with the main portion of the strap being slidably movable in said passage for locating said housing at a desired location along the length of the main portion of the strap;

a blind compartment formed in said housing in stacked relationship with the passage and having one end closed by an upstanding wall and an opposite end and a top being open for receiving the free end of the strap when the main portion of the strap extends through the passage and the loopeded-over portion of the strap in a juxtaposed position relative to main portion of the strap;

a lid mounted on an upper end of the upstending wall of said compartment for movement into a closed position with the top of the compartment for grippinly engaging the free end of the strap when the free end is placed therein;

said housing further including a spaced apart pair of side walls which define opposite sides of said passage and said compartment with an inwardly facing pair of grooves formed adjacent top edges of said pair of side walls;

a partition extending between said spaced apart pair of side walls to interconect said pair of side walls and separate said passage and said compartment;

a hinge interconnecting the lid with the upper end of the upstanding wall; and said lid having opposite side edges which enter into the inwardly facing pair of grooves formed in said walls when the led is moved into the closed position.

11. A clasp as claimed in claim 8, wherein said lid is provided with an array of teeth which grip the free end of the strap when it is positioned in said compartment and the lid is moved into the closed position.

* * * * *